United States Patent [19]

Lespinasse

[11] 4,150,503

[45] Apr. 24, 1979

[54] APPARATUS FOR EXCAVATION AND EARTH REMOVAL FROM AQUATIC BOTTOMS

[76] Inventor: Pierre Lespinasse, 34, Rue du Lycee, 92330 Sceaux, France

[21] Appl. No.: 759,976

[22] Filed: Jan. 17, 1977

Related U.S. Application Data

[63] Continuation-in-part of Ser. No. 592,454, Jul. 2, 1975, abandoned, which is a continuation of Ser. No. 390,417, Aug. 22, 1973, abandoned.

[30] Foreign Application Priority Data

Aug. 22, 1972 [FR] France ..... 72 29897

[51] Int. Cl.[2] ..... E02F 3/44; B63C 7/20

[52] U.S. Cl. ..... 37/71; 37/56; 114/53; 114/55; 414/23

[58] Field of Search ..... 37/54, 56, 71, DIG. 1, 37/DIG. 8, 183 R; 114/49–55, 16.8; 214/3

[56] References Cited

U.S. PATENT DOCUMENTS

| | | | |
|---|---|---|---|
| 268,345 | 11/1882 | Wood | 37/184 X |
| 501,122 | 7/1893 | Walsh | 37/71 X |
| 1,281,949 | 10/1918 | Gustafson | 114/53 |
| 1,415,532 | 5/1922 | De Vito | 114/53 |
| 1,691,738 | 11/1928 | Powell | 114/53 |
| 1,767,672 | 6/1930 | Hills | 114/53 |
| 1,854,026 | 4/1932 | Gamba | 114/53 |
| 1,881,123 | 10/1932 | Francis | 114/53 |
| 1,957,622 | 5/1934 | Visnyei | 114/53 X |
| 2,280,547 | 4/1942 | Scofield | 114/52 |
| 2,355,086 | 8/1944 | Lang | 294/66 A |
| 3,017,719 | 1/1962 | Sigler et al. | 214/3 X |
| 3,415,068 | 12/1968 | Casey, Jr. et al. | 37/56 X |
| 3,572,129 | 3/1971 | Walthier et al. | 37/56 UX |
| 3,593,533 | 7/1971 | Washington | 37/56 X |
| 3,722,448 | 3/1973 | Leonardi | 114/55 |
| 3,726,349 | 4/1973 | Heusler et al. | 175/238 X |
| 3,732,838 | 5/1973 | Kriedt, et al. | 114/51 X |
| 3,782,317 | 1/1974 | Kriedt et al. | 114/52 |
| 3,812,922 | 5/1974 | Stechler | 37/56 X |
| 3,967,394 | 7/1976 | Kelley et al. | 37/71 |

FOREIGN PATENT DOCUMENTS

| | | | |
|---|---|---|---|
| 1759981 | 7/1971 | Fed. Rep. of Germany | 37/71 |
| 1137258 | 1/1957 | France | 37/184 |
| 4527 of | 1878 | United Kingdom | 114/53 |
| 136188 | 12/1919 | United Kingdom | 114/51 |
| 145268 | 7/1920 | United Kingdom | 114/51 |
| 312712 | 6/1929 | United Kingdom | 114/51 |
| 306046 | 8/1971 | U.S.S.R. | 114/51 |

*Primary Examiner*—Clifford D. Crowder
*Attorney, Agent, or Firm*—Edwin E. Greigg

[57] ABSTRACT

A floatable apparatus provided with a lifting element for displacing it between the surface and bottom of a water basin has at least two jaws or grippers which are suitable for use as a clam-shell bucket or the like. The jaws are suspended from the lifting element and are articulated with respect to one another. The lifting element is constituted by a principal floatable buoyant caisson which permits the apparatus to be placed in a state of immersion or of floatation. At least one floatation chamber is associated with each of the jaws to achieve selectably a net density thereof equal to, less than or greater than that of water. The jaws are carried by the principal caisson.

8 Claims, 7 Drawing Figures

APPARATUS FOR EXCAVATION AND EARTH REMOVAL FROM AQUATIC BOTTOMS

REFERENCE TO RELATED APPLICATIONS

This application is a continuation-in-part application of Ser. No. 592,454, filed July 2, 1975 now abandoned, which application is a continuation of Application Ser. No. 390,417, filed Aug. 22, 1973, now abandoned.

BACKGROUND OF THE INVENTION

This invention is concerned with a floatable apparatus which includes at least two jaws or grippers useful as a clam-shell bucket or the like. The present invention concerns, more particularly, improvements to clam-shell diggers of the type constituted by at least two jaws articulated around a common axis of a lifting element. The jaws are arranged in such a way that while closed, they constitute a gripper, a pocket or a transport bucket for the materials which are clamped or contained therein. In an open position and when they are situated at the level of the body or bodies to be grasped or when they lie on the bottom of a water basin, they constitute two grasping elements or two digging elements. The removal or excavation is effected by a simple approachment of the jaws toward one another, upon an appropriate command. The closure and approachment of the jaws are, in fact, effected by conventional devices, either by use of appropriate cables or by action of hydraulic jacks. In all cases, these prior art techniques and devices are incapable of permitting the removal of very large quantities of soil, of the order for example of several hundreds of tons, in one single operation at some considerable depth of water, such as for example at sea bottom. With conventional techniques it would be necessary:

either to arrange above the removal area for a floating pontoon which carries the maneuvering apparatus of the clam-shell digger and generally constituted by a crane, and subsequently by maneuvers of descent, grasping and lifting in succession, to discharge the removed soil into a nearby vessel, which, once filled up, must return to the discharge area while it is possibly replaced by another identical vessel in the vicinity of the crane; the risks connected with such maneuvers, especially during heavy seas, are well known;

or, it is necessary to employ an excavation apparatus, such as is defined above, and which itself constitutes a part of a vessel, but then there results a very poor utilization of the equipment, because during the periods of coming and going between the discharge port and the area of removal, considerable portions of the equipment are unused for significant periods.

It is known, incidentally, to make vessels whose hulls are constituted of two symmetrical halves with respect to the median plane, and which are articulated toward each other around an axis, in a general form of jaws and where each of these halves is equipped with floatation chambers or caissons into which water may be admitted or from which it may be purged by the action of compressed air. However, in such vessels the opening and closing of the jaws is effected by an independent device, such as hydraulic jacks, which mechanically act upon the jaws in the sense of effecting their opening or their closing. This presents numerous inconveniences, especially whenever one intends the utilization of the apparatus at great depths.

OBJECT AND SUMMARY OF THE INVENTION

It is an object of the present invention to provide an improvement in a floatable apparatus suitable for use as a digger which eliminates the necessity of transshipping the soil or bodies removed from the bottom of a water basin.

It is another object of the present invention to provide an improvement in a floatable apparatus suitable for use as a digger which itself serves to excavate, to lift and to transport the soil or bodies from the bottom of a water basin.

It is a further object of the present invention to provide an improvement in a floatable apparatus suitable for use as a digger which is of simple economical construction.

It is an additional object of the present invention to provide an improvement in a floatable apparatus suitable for use as a digger which avoids the necessity of transferring the removed soil or bodies in the complete installation which includes a vessel or ship which can thus remain stationary while the load is moved.

It is still another object of the present invention to retain the jaws of the floatable apparatus in a fully opened and raised position while it is being lowered toward the bed of a body of water until such time as a depth detection device associated with the caisson determines that the caisson is a predetermined distance above the bed of the body of water by its contact therewith at which time a sequence of events takes place in which, almost simultaneously with the determination of the distance at which the caisson is located above the bed of the body of water, an air release valve is triggered to evacuate the air from the jaws so they will descend and begin to dig in the bed of the body of water.

It is a still further object of the invention to provide at least one of the hollow arms with an actuator element that controls a valve means on the caisson which functions to set into action a sequence of elements to purge the water from the caisson so that air is forced into the caisson and the apparatus can float to the surface.

it is yet another object of the present invention to provide an improvement in a floatable apparatus suitable for use as a digger which avoids the need of hydraulic jacks and/or cables to open and to close its jaws and in which the closure of the jaws toward one another in order to grasp soil and other marine matter therebetween is caused entirely and solely by admission of compressed air into a central principal caisson while the water is expelled therefrom through simple orifices in the bottom. Accordingly, when the lighter, air-filled caisson rises toward the surface of the body of water, the heavier, water-filled jaws tend to close by moving toward one another under the influence of gravity alone.

The foregoing objects, as well as others which are to become clear from the text which follows, are achieved in a floatable apparatus having, preferably, displacement means and at least two jaws or grippers. The two jaws or grippers are suitable for use as a clam-shell bucket or the like. The jaws are suspended from a lifting element and are articulated with respect to one another. The jaws are operatively arranged so that in a closed position they constitute a bucket or a pincer for transport of materials which are contained therein or are gripped thereby. In an open position, the jaws constitute, when resting on the top of soil, of a body or of bodies to be grasped, instrumentalities for removal or excavation thereof. In order to the grasping operation, the jaws mutually approach one another upon execution of an appropriate command the effect of which is to admit compressed air into a principal, floatable, buoyant caisson which constitutes the main part of the lifting element and which permits the apparatus to be placed alternatingly in a state of immersion and in a state of floatation. At least one floatation chamber is associated with each of the jaws for achieving a net density thereof which is selectably greater than, equal to or less than water. The jaws are carried by the principal caisson.

The floatable apparatus according to a feature of the invention is constituted of a caisson, subsequently referred to as a principal caisson, which is intended to be immersed. The principal caisson carries on its lower side at least one orifice for purging the water and which is preferably provided, at its upper side, with means for admitting and evacuating compressed air and on which are arranged, preferably around a common axis, two jaws of a clam-shell bucket. Each of the jaws includes a floatation chamber arranged in such a way as to permit, as desired, a net density which is either greater than, equal to or less than that of water.

According to a preferred embodiment, each floatation chamber is itself constituted of a caisson, henceforth referred to as a secondary caisson, which is integral with the jaw and which has at its lower part at least one orifice for admitting or evacuating water and also has at its upper part a means for the admission and evacuation of compressed air.

The principal caisson has, incidentally, towing equipment of a conventional type.

The admission of compressed air into the principal caisson is metered in such a way that the complete assembly floats or is only lightly immersed so that the assembly of the apparatus can thus be towed to the place directly above the removal or excavation area. In further operation, the two secondary caissons are then placed in a state of compression in such a way that water is purged from them, whereas the principal caisson is placed in a state of decompression which results in the immersion of the assembly with its jaws open, the volume of the secondary caissons, of course, being calculated in such a way as to permit holding the jaws in the required open position when the principal caisson is completely immersed.

It should be remarked, however, that, if the condition of the sea does not permit traveling on the surface, it is possible to meter the amount of compressed air in such a way that the assembly remains more or less immersed. This brings the advantage of protecting the caissons from movements of the swell and also to prevent agitation of the upper layers of the contents in the bucket formed by the closed jaws. Such agitation might cause a dispersion of the load.

The assembly will hereinafter be called a floatable apparatus for convenience of terminology even though it is possible to make it submersible at will. When the floatable apparatus arrives in the port, it is led over a discharge bottom, the compressed air is again admitted in the secondary caissons in such a way as to cause the opening of the jaws. This maneuver could be facilitated by light admission of water into the principal caisson which is obtained by a suitable decompression of the latter. The removed soil can then be reclaimed from the discharge area, which of course is chosen to be in the immediate vicinity of the quay, by conventional lifting machines which effect the loading into the preferred transport means.

The invention has still other characteristics which will become evident in the reading of the detailed description which will follow with reference to the various drawing figures.

DESCRIPTION OF THE PREFERRED EMBODIMENTS

The floatable apparatus according to the present invention as illustrated in FIGS. 1–4 include a principal floatable buoyant caisson 1 on which are articulated, around coaxal pivots 4, 5, jaws 3, analogous to the jaws of a clam-shell bucket.

Figure 4:
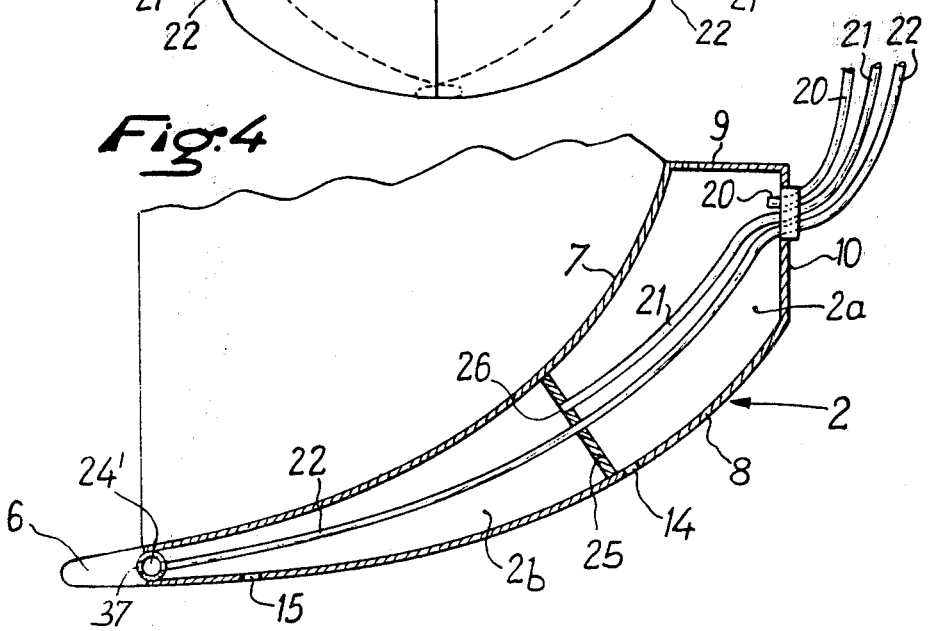
FIG. 4 is a detailed illustration, on a larger scale, of a cross-sectional showing of the jaw shown in the plan views of FIGS. 2 and 3.

In the illustrated embodiment, the jaws 3 are provided, on their respective working edges, with a plurality of teeth 6 which in the position of closure of the jaws 3, interlace each other in a known fashion. The jaws 3, in principle, constitute along their entire length a volume with a double wall made up of the interior and exterior walls 7, 8 and the upper and lateral end walls 9, 10 (FIG. 4). This disposition, together with the teeth 6 and the tooth gaps which are not referenced and which separate each two consecutive ones of the teeth 6, define a jaw 3 formed in part by a secondary water-tight caisson 2, which is closed at each of its ends by end plates such as 11 and 12 belonging to each of the jaws 3.

The principal caisson 1 and the secondary caissons 2 also have, preferably at their lower face, a plurality of orifices for the admission and evacuation of water, such as 13 (FIG. 2), 14 and 15 (FIG. 4).

Figure 1:
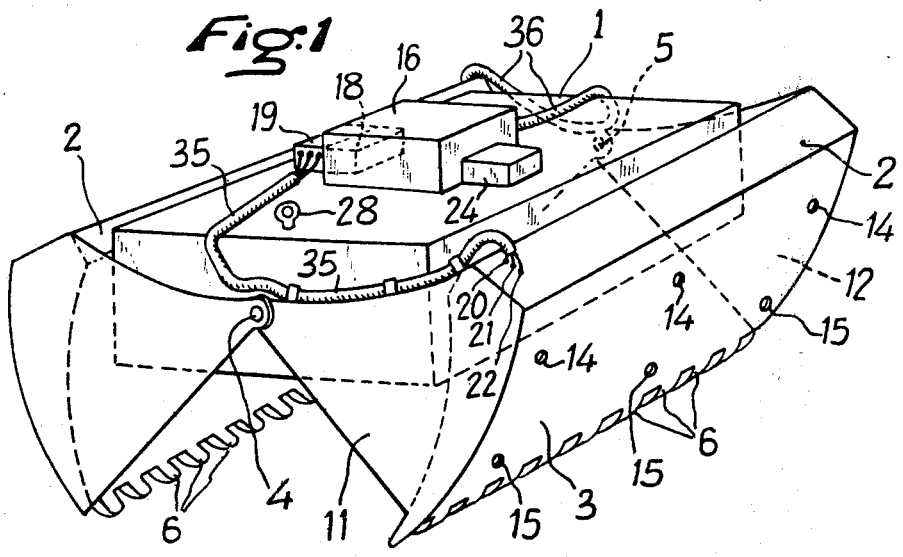
FIG. 1 is a plurality schematic perspective view of an apparatus for excavation, lifting and transporting according to the present invention.
Figure 3:
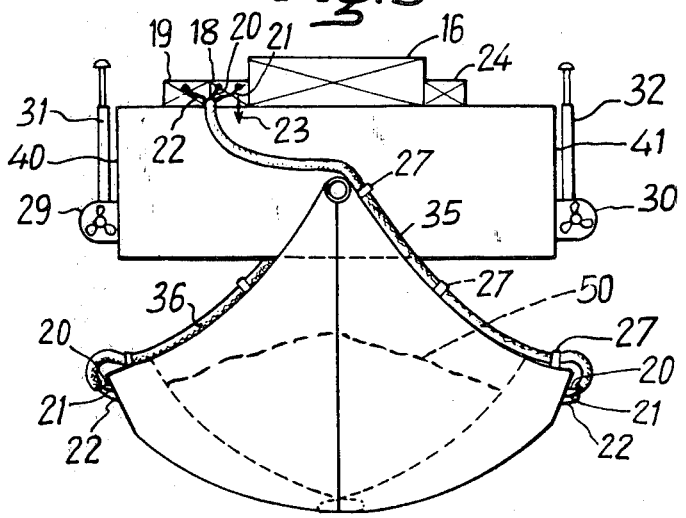
FIG. 3 is a partially schematic end view of the apparatus illustrated in FIG. 1, the jaws being shown in the position of closure.

On the upper portion of the principal caisson 1 there is placed a device 16, which is indicated schematically in FIGS. 1 and 3, and which consists either of a battery of compressed air containers attached to the caisson 1 by demountable stowage means, or a water-tight caisson which is attached so as to accept a charge of compressed air at high pressure. In both cases, the device 16 is connected by a suitable tubing to valve devices 18 and 19 which admit the compressed air into the principal caisson 1 and the secondary caissons 2.

The valve devices 18 and 19 are constructed in a well-known conventional manner, which has not been shown, of a pressure reducer associated with a number of closure valves which correspond to the channels to be supplied or not supplied with air. In the example shown, the device 18 serves two tubes 20 and 21 which are connected to one of the secondary caissons 2, as well as a direct communicating orifice which is not shown, but is schematically indicated in FIG. 3 by the arrow 23, and through which the principal caisson 1 is supplied with compressed air. The device 19 services a tube 22 which terminates at the elongated ejection chamber 24' equipped with nozzles 37 and situated at the bottom of the space separating each two consecutive ones of the teeth 6 and whose utility will be explained below.

The device 18 also has, at the beginning of each of the tubes 20 and 21, a valve which permits decompressing of the secondary caissons 2, whereas the decompression of the principal caisson 1 is accomplished in the illustrated embodiment by an independent valve mechanism 24, shown diagrammatically.

The secondary caissons 2 are each subdivided into two compartments or chambers 2a, 2b, as illustrated for one in FIG. 4, by the placement of a wall 25 which separates these two chambers in a water-tight manner. The tube 20 terminates directly in the chamber 2a, whereas the tube 21 terminates in the chamber 2b at an orifice 26 which traverses the partition 25 which is also traversed in water-tight manner by the tube 22 serving the elongated ejection chamber 24'.

Of course, the two secondary caissons 2 of each of the jaws 3 are served in identical fashion and the three tubes or tubes 20, 21 and 22, which supply each of the secondary caissons 2 are combined in a common sheath 35, 36 which is attached to each jaw 3 by collars, such as collar 27, beginning at each coaxial pivot 4, 5.

All the valve devices 18, 29, 24 which have been mentioned above for admitting compressed air into one or the other of the caissons 1, 2 or for the decompression of the caissons 1, 2 are provided with control means not shown for accepting remotely appropriate commands (control signals) so that an operator who would be located on a nearby vessel, could switch them selectively at will to an either active or inactive position. The control signals can be transmitted, in known manner, by cable, or by radio, to the appropriately configured known control means.

The nozzles 37, which are situated at the intersection between the teeth 6 and supplied with air by the elongated chamber 24' and by the tube 22, can be used, by admitting compressed air at appropriate pressure, either for loosening or cleaning the seat or basin bottom in the area of excavation when the jaws 3 are open and are in its immediate vicinity, or for ridding the teeth of foreign bodies and particularly of remains of soil or rocks which had been excavated and which could remain therein or adhere thereto or remain wedged after the discharge of the contents of the bucket formed by the closed jaws 3, or else yet for relieving by simple counterpressure defects in the water-tightness of the closure of the apparatus.

Figure 2:
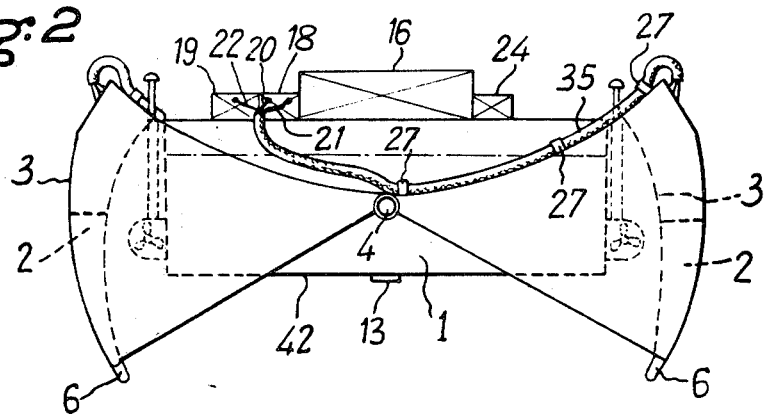
FIG. 2 is a partially schematic end view of the apparatus illustrated in FIG. 1, the jaws being shown in their completely open position.

The movement of the apparatus can be effected either by towing with the aid, for example, of a towing ring 28 (FIG. 1) or in independent fashion by means, for example, of two remotely controlled motors 29, 30 which may be placed at one or the other portion of the principal caisson 1 (FIGS. 2 and 3). These motors 29, 30 can be actuated by electricity with the aid of suitable electrical batteries placed in or on the principal caisson 1. If the excavation or removal area is not situated under too great a water depth, they can also be diesel motors whose combustion air and exhaust gas are carried in telescopic snorkles 31, 32 (FIGS. 2 and 3).

Of course, the propulsion could also be effected by a single motor disposed at a lower part of the principal caisson 1 within its symmetry plane, where the direction of the machine would be controlled in conventional fashion by a rudder (not shown). It seems, however, that the embodiment illustrated is such as to represent a better realization by reason of the fact that when the jaws 3 are closed, then the laterally disposed propellers associated with the motors 29, 30 are well exposed. At the same time, it is advantageous to control the direction of motion by differing the rotational speed of motors 29, 30 or by inverting their sense of rotation in the case that one wishes to pivot the machine practically in place, or still differently by stopping one of the two motors 29, 30.

It should be noted that the jaws 3 are of such dimensions that when they are completely open, they touch at some part of the sides 40 or 41 of the principal caisson 1 in such a way that for the total open position, their biting edges carrying the teeth 6 are at the same level as a lower face 42 of the principal caisson 1, or at most are slightly displaced from the plane of that face. This arrangement permits an efficient penetration of the jaws 3 into the excavation area, that is to say, a more complete filling up of the bucket forming by the closed jaws 3.

Let the apparatus now be considered to be at its initial position in the port where, on the one hand, it floats through the effect of a suitable regulation of the volume of water admitted in its principal caisson 1 by the effect of compressed air therein introduced, and where also the jaws 3 are placed in a position of closure by decompressing the chambers 2a, 2b of the secondary caissons 2 which are therefore flooded. Subsequently, the apparatus is brought to the immediate vicinity of the excavation ground, for example, vertically above it, either by towing or by actuating the independent propulsion motors 29, 30.

By actuating suitable valves with the aid of their associated remote control means, the principal caisson 1 is then placed in a state of decompression which permits water to flood it through the orifices 13, whereas at least one of the chambers 2a, 2b of each jaw 3 is placed into a state of compression which has the effect of purging the water through the orifices 14, 15. The entire assembly is, of course, calculated to be such that, in spite of purging the water from chambers 2a and/or 2b, the total density of the assembly of the apparatus is, nevertheless, greater than that of the water. Hence the apparatus becomes immersed and it drops in the direction of the excavation ground. During this descent, its stability is nevertheless ensured by the fact that the jaws 3, whose secondary caissons 2 are purged, either totally or partially, have a lower net density than that of the principal caisson 1.

The partitioning of the secondary caissons 2 into two chambers 2a, 2b which are independent from one another and which are also supplied independently with compressed air, enables the realization in a very simple way of a certain control of the degree of buoyancy of these caissons. In fact, whereas it would be very difficult to have to control, from the surface of the water, the exact air pressure admitted thereto, it is, on the contrary, very simple merely to operate a control which is of the "all or nothing" kind, i.e., by completely purging either the chambers 2a or the chambers 2b or both at once. Of course, a finer control could be realized by multiplying the number of chambers, like the chambers 2a or 2b, by the adjunction of supplementary partitions, like the partitions 25, which could be disposed within the jaws 3 either in a longitudinal or in a transverse sense.

As explained later herein, the apparatus approaches the excavation area with its jaws 3 open. Depending on the residual velocity of the apparatus and its relative density with respect to the water, its jaws 3 dig more or less completely into the soil of the excavation area. The secondary caissons 2 are then placed in a state of decompression by an appropriate maneuver of the decompression valves, and this has the effect of increasing the penetration of the jaws 3 into the soil. The principal caisson 1 is then progressively placed in a state of compression and this has the result of raising it progressively above the level of the excavation area and by the simple effect of gravity, results in the complete closure of the jaws 3. During this movement the jaws 3 confine a smaller or greater quantity of soil depending on the severity of the movement.

When the jaws 3 have completely closed again, the assembly of the apparatus is in the position shown in FIG. 3, where the jaws 3 retain a load 50 of the excavated soil.

The upward movement is continued, while retaining the relative position of the parts, until the principal caisson 1 approaches the surface of the water and the air pressure therein is maintained at a value necessary for the degree of immersion judged to be suitable. The means of propulsion, such as provided by the motors 29, 30, or of towing, are thereafter actuated and the apparatus is directed toward the discharge area.

One should nevertheless note that, if the condition of the sea is such as to make the surface transport difficult or delicate, it is possible to adjust the compressed air pressure in the principal caisson 1 in such a manner that it stays submerged at a depth so that surface movements of the water do not have disadvantageous repercussions for the transport of the apparatus or the maintenance of its load.

When the apparatus has arrived in the discharge port, it is led above a discharge location of moderate depth and by an appropriate maneuver of its control valves, the chambers 2a and/or 2b of the secondary caissons 2 are again purged of the water that has filled them; this results in an opening of the jaws 3 and the discharge of their contents.

The soil, gravel or pieces of rock which were excavated are then picked up from the discharge area by conventional manipulation devices, such as clam-shell buckets, dredges or the like, by the means of which one effects the loading of transport cars or effects dry storage in areas of one's choice.

The very simple conception of the floating apparatus with a clam-shell bucket according to the invention, as well as the simplicity of the means used for realizing the different maneuvers which are required, especially with respect to its immersion or its floatation and with respect to the opening or closure of the jaws 3, permits the realization of such apparatuses that have extremely large dimensions and are capable, for example, of excavating and carrying to port, in one single operation, quantities of soil, gravel or rock elements of the order of several hundreds of tons.

Figure 5:
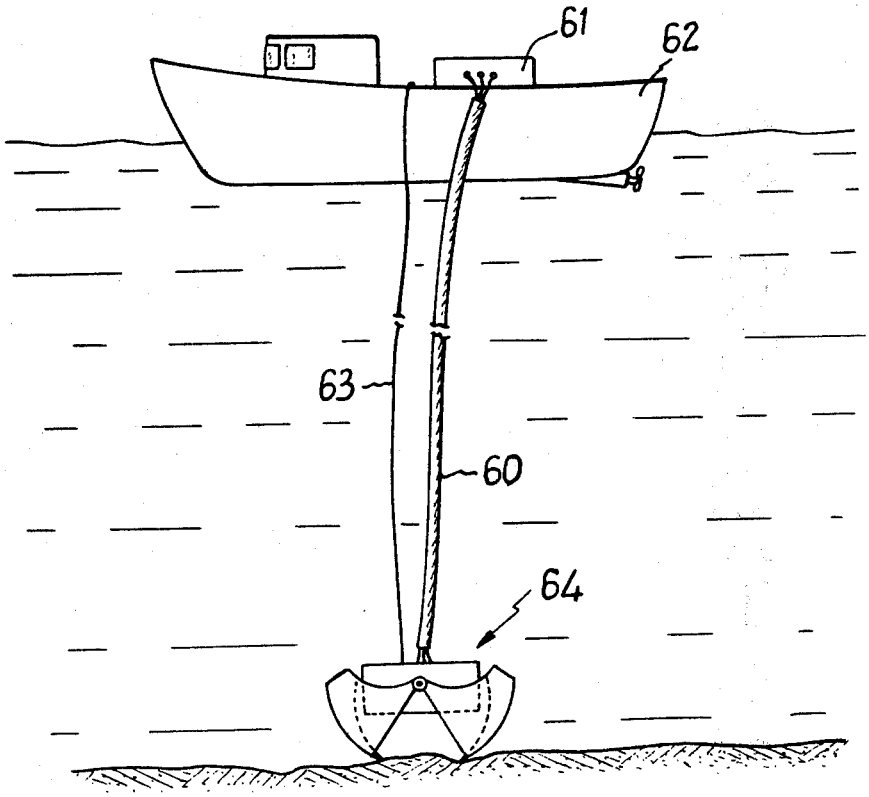
FIG. 5 is a schematic illustration of a variant embodiment of the present invention.

The independent apparatus described above constitutes a preferred embodiment of the invention. However, one should note that, especially as concerns apparatuses of relatively low tonnage, it could be considered advantageous to have recourse to the embodiment illustrated in FIG. 5 which is different from the former only in the method of supplying compressed air to the different caissons. As shown in FIG. 5, the compressed air supply is at the surface, which supply is coupled to the apparatus 64 via a number of suitable tubes or channels combined within a common sheath 60 and which terminate at an assembly 61 which carries an air compressor and suitable admission valves, actuated in well-known manner by known control means, for admitting the compressed air into each of the channels and also for admitting atmospheric air to each of the channels. The assembly 61 is carried by a neighboring vessel 62. Preferably, the apparatus according to the invention, designated here by the general reference 64, is secured by a cable 63 installed in such a way that the possible tensions which could be imposed by the apparatus are absorbed by the cable 63 and not by the tubes or channels contained within the sheath 60.

If it is not desired to employ an "all or nothing" control which has the effect either of complete purging of the caissons or chambers in question, or their complete flooding with water, one can adjust the compressed air pressure in each caisson to a value slightly different from that of the water pressure which, itself, is in equilibrium with that of the ambient medium.

It should be noted that by arranging the control means respectively separate for each of the jaws 3, it is possible to make these jaws execute asymmetric movements (for example a more rapid descent of the one with respect to the other or an ascent of one and a simultaneous descent of the other) if the necessities of the exploitation make this maneuver desirable. This could, for example, be the case for raising or moving a load or body which is too large to be conveniently grasped between the two jaws 3.

It should also be noted that one could dispose a plurality of jaws or of grippers, each rigidly connected to a secondary caisson according to the invention and articulated around different axes which need not be parallel to one another, in such a way as to achieve a better adaptation of the machine to forms or dimensions of the bodies to be displaced when these have a predetermined form or dimension, e.g., long poles, spheres or irregular shapes.

Thus, for example, according to one particular embodiment, the principal caisson has, in a central portion, a well (shaft, pit) which extends completely through the caisson from its lower face to its upper face. The apparatus is equipped with four jaws articulated around four axes carried by the principal caisson and distributed around the well at its lower part. This distribution makes it possible to form a pincer permitting the transport of a long vertical tube or pipe which traverses the well.

Figure 6:
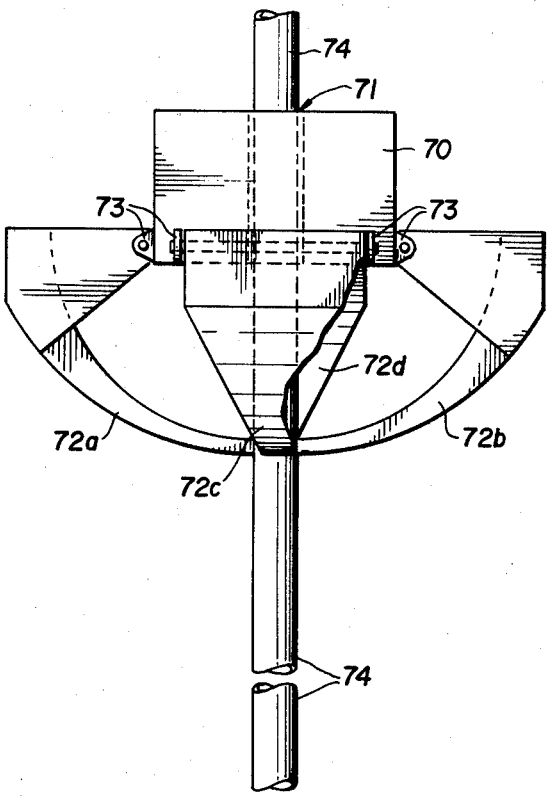
FIG. 6 is another embodiment of the present invention and depicts in horizontal elevation an improved device for extracting and carrying a piling in a body of water.

In the embodiment illustrated in FIG. 6, the main caisson 70 has attached to it a plurality of symmetrically spaced pivoting jaws 72 a, b, c, d, pivoted at hinges 73. These jaws are actuated substantially in the same manner as the jaws in the preceding examples; the various valves and hoses therefor are not shown in this figure. A passage 71 in the main caisson 70 permits the passage of an elongated object, e.g., a piling or a beam, etc. In operation, the caisson is manuevered over an upwardly extending object 74 and is lowered to the floor of the basin. Subsequently, the buoyancy of the apparatus is changed in the manner previously described so that, after overall positive buoyancy is established, the jaws grip the elongated object 74 and carry it along in an upward or downward direction.

Figure 7:
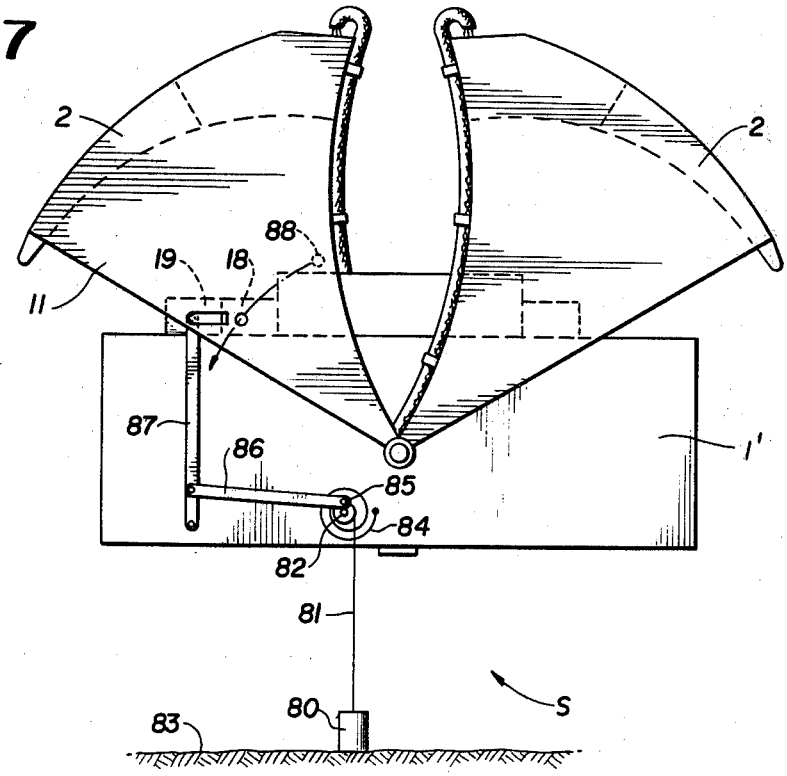
FIG. 7 is a horizontal elevational view of the principal caisson with its cooperative jaw members uplifted at the start of a descent down into a body of water.

Turning now to the view in FIG. 7, which shows a bottom sensor mechanism which may be used in association with the caisson it will be noted that the hollow secondary caissons 2 are elevated and more or less simulate a parachute. The apparatus is lowered into the body of water and ultimately attains a position in which a weight 80 that is supported by a flexible cable 81 from a stub shaft 82 will contact the soil illustrated at 83. At this time, the cable 81 is provided with a slack and the spring element 84 begins to rotate the shaft 82 to wind up the cable. An eccentric element 85 carried by the shaft 82 is also caused to rotate therewith and engages a lever 86 causing it to move a lever 87 which will operate a control on device 18 thus causing the secondary caissons 2—2 to begin their descent.

As also viewed in the drawing in FIG. 7, the left side plate 11 is provided with a triggering device 88 which as indicated by the arcuate dot dash line and an arrow passes in front of the device 18 and causes it to actuate a control element for a valve in the device 18 which may send a command signal to the mother ship at the surface so that air will be forced into the caisson 1' and the water purged therefrom and the apparatus can begin to rise from the bed of the body of water with the hollow jaws closed about the soil. Alternatively, the triggering device 88 may actuate the valve in the device 18 directly.

It is to be understood that the embodiments described above and shown do not present any limiting character. Numerous variants could be made without thereby departing from the spirit and scope of protection of the invention, which is defined in the appended claims.

What is claimed is:

1. In a floatable apparatus having propulsion means and at least two jaws or grippers, suitable for use as a clamshell bucket or the like, articulated with respect to one another around at least two coaxial pivots, suspended from caisson means and operatively arranged so that in a closed position of said jaws, these jaws define means for transport of materials and in an open position these jaws constitute, when resting on top of material, instrumentalities for removal of at least a portion thereof, which jaws mutually approach one another upon execution of an appropriate command, the improvement comprising in combination: principal, floatable, buoyant caisson means for permitting the apparatus to be placed alternatingly in a state of immersion and in a state of floatation, and floatation chamber means associated with each of said jaws constituted by at least one secondary caisson means formed in the hollow interior of said jaws and carrying at least one orifice and means for selective admission and evacuation of compressed air for said secondary caisson means independently of any air provided for said principal caisson means for achieving a net density of said jaws which is selectably greater than, equal to or less than that of water, said jaws being carried solely by said principal caisson means and being so connected that either of said jaws and its respective floatation chamber always move together, in the same direction, and on the same side of a vertical plane bisecting said coaxial pivots; and means for admitting compressed air to said principal and secondary caissons, and wherein said principal caisson means has at least one water-tight compartment intended to receive a compressed air charge, said water-tight compartment has an orifice at a lower portion thereof for permitting the passage of water to and from said principal caisson and said compartment is connected to said means for admitting compressed air whereby opening and closing of the jaws is effected by air and water fed selectively into the floatation chambers of said jaws, immersion is effected by water fed into said principal caisson and closing of the jaws is effected by water being let into said floatation chambers of said jaws while air is fed into said principal caisson means.

2. An apparatus according to claim 1, wherein said at least one secondary caisson means is constituted by at least two secondary caissons integral with one jaw of said jaws, of which one of said secondary caissons is disposed at an upper part of said one jaw and the other of said secondary caissons is disposed at a lower part of said one jaw adjacent to a working edge of said one jaw, the separating wall between said secondary caisson being substantially perpendicular to the outer walls thereof.

3. An apparatus according to claim 1, wherein said principal caisson means comprises a principal caisson having a lower surface which lower surface, when said jaws are open to their maximum extent is substantially at the level of operative edges of said jaws.

4. An apparatus according to claim 1, wherein said principal caisson means includes value means for admitting compressed air and is equipped with at least one removably stored container of compressed air and with connecting means connecting this container to said value means for admitting compressed air.

5. An apparatus according to claim 1, in combination with a floating structure which carries means for supplying compressed air, and wherein said principal caisson means is connected by at least one suitable conduit to said floating structure which carries said means for supplying compressed air.

6. An apparatus according to claim 1, further including a supply channel for compressed air and control means for controlling admission of compressed air thereto, and wherein said jaws are provided at their respective working edges with a plurality of nozzles connected to said supply channel for compressed air, said control means making it possible to effect controlled admission of compressed air to said nozzles.

7. An apparatus as defined in claim 1, in which said buoyant caisson is provided with a plurality of symmetrically spaced pivotable jaws capable of being brought into engagement with a submerged perpendicularly disposed object to carry the same within a body of water.

8. An apparatus as defined in claim 7, in which said buoyant caisson includes means defining a vertical opening which is equally spaced from the pivot point of the symmetrically disposed jaws.

* * * * *